US006648799B2

(12) United States Patent
Hall

(10) Patent No.: US 6,648,799 B2
(45) Date of Patent: Nov. 18, 2003

(54) FOLDABLE TRAMPOLINE

(76) Inventor: David Hall, 364 W. 200 N., Manti, UT (US) 84642

( * ) Notice: Subject to any disclaimer, the term of this patent is extended or adjusted under 35 U.S.C. 154(b) by 0 days.

(21) Appl. No.: 09/843,022

(22) Filed: Apr. 26, 2001

(65) Prior Publication Data

US 2002/0160884 A1 Oct. 31, 2002

(51) Int. Cl.[7] ..... A63B 5/11
(52) U.S. Cl. ..... 482/28; 482/27; 482/148
(58) Field of Search ..... 482/28, 27, 148

(56) References Cited

U.S. PATENT DOCUMENTS 2,534,019 A * 12/1950 Griswold ..... 482/28
3,116,809 A * 1/1964 Nissen ..... 482/28
3,276,544 A * 10/1966 Hall ..... 482/28
3,356,366 A * 12/1967 Barthel ..... 482/28
4,386,772 A 6/1983 Wu ..... 272/65
4,415,151 A * 11/1983 Daniels ..... 272/65
4,630,816 A * 12/1986 Hill ..... 272/70
4,824,100 A * 4/1989 Hall et al. ..... 482/28
6,110,074 A * 8/2000 Tacquet ..... 482/27

* cited by examiner

*Primary Examiner*—Nicholas D. Lucchesi
*Assistant Examiner*—Lori Baker Amerson
(74) *Attorney, Agent, or Firm*—Lloyd W. Sadler

(57) ABSTRACT

An exercise device, such as a trampoline, that is foldable with long-lasting rigidity in the framework. The trampoline is made foldable by using hinges to connect sections of the frame of the trampoline. The hinges are configured to provide lateral flexibility in the framework, thereby decreasing the stress applied to the hinges (and increasing the life of the hinges) when the trampoline is folded.

17 Claims, 9 Drawing Sheets

FOLDABLE TRAMPOLINE

FIELD OF THE INVENTION

The present invention generally relates to exercise apparatus and methods for using the same. More particularly, the present invention relates trampolines and methods of using the trampolines. Even more particularly, the present invention relates to a tri-fold foldable trampoline and method of using the same.

BACKGROUND OF THE INVENTION

The current emphasis on physical fitness has resulted in a proliferation of various devices useful in performing various exercises. Among these devices are apparatuses based on the trampoline, but smaller and more portable. See, for example, U.S. Pat. Nos. 4,386,772, 4,415,151, and 6,110,074, the disclosures of which are incorporated herein by reference. Such rebound devices or mini-trampolines are particularly popular for simply jogging-in-place or similar exercises One such exercise device that has proven popular has a circular framework about one meter in diameter and resiliently supporting a flexible mat by a plurality of coiled springs. A plurality of legs support the framework above a floor or other suitable support surface, while an annular cover arranged on the framework covers the springs adjacent an upper surface of the mat for safety and aesthetic reasons. When fully assembled, an individual can perform a variety of aerobic exercises which improve muscles tone, blood and lymph circulation due in part to increased cellular and muscular stress imparted by the variation of gravitational force encountered during exercising.

One drawback to the apparatus discussed above is that their size, while much smaller than a standard trampoline, creates storage and portability difficulties. Accordingly, it has been proposed to permit the apparatus to be folded into a smaller package simply by placing four identical hinges equally spaced in the circular framework to permit folding the framework into a smaller size. Problems have been encountered, however, with such an arrangement, inasmuch as the hinges tend to buckle during use of the device, and generally do not provide the necessary rigidity to the framework for proper operation of the apparatus.

SUMMARY OF THE INVENTION

The present invention provides an exercise device, such as a trampoline, that is foldable with long-lasting rigidity in the framework. The trampoline is made foldable by using hinges to connect sections of the frame of the trampoline. The hinges are configured to provide lateral flexibility in the framework, thereby decreasing the stress applied to the hinges (and increasing the life of the hinges) when the trampoline is folded.

BRIEF DESCRIPTION OF THE DRAWINGS

One aspect of the present invention will be described in conjunction with FIGS. 1–9, where:

FIGS. 1–9 presented in conjunction with this description are views of only particular—rather than complete—portions of apparatus and methods of collapsing or folding the apparatus.

DETAILED DESCRIPTION OF THE INVENTION

The following description provides specific details in order to provide a thorough understanding of the present invention. The skilled artisan would understand, however, that the present invention can be practiced without employing these specific details. Indeed, the present invention can be practiced by modifying the illustrated apparatus and method and can be used in conjunction with apparatus and techniques conventionally used in the industry. For example, the present invention is described with respect to a "mini"-trampoline, but the present invention could be easily modified for a "regular" trampoline or similar exercise device such a bouncing device.

Figure 1:
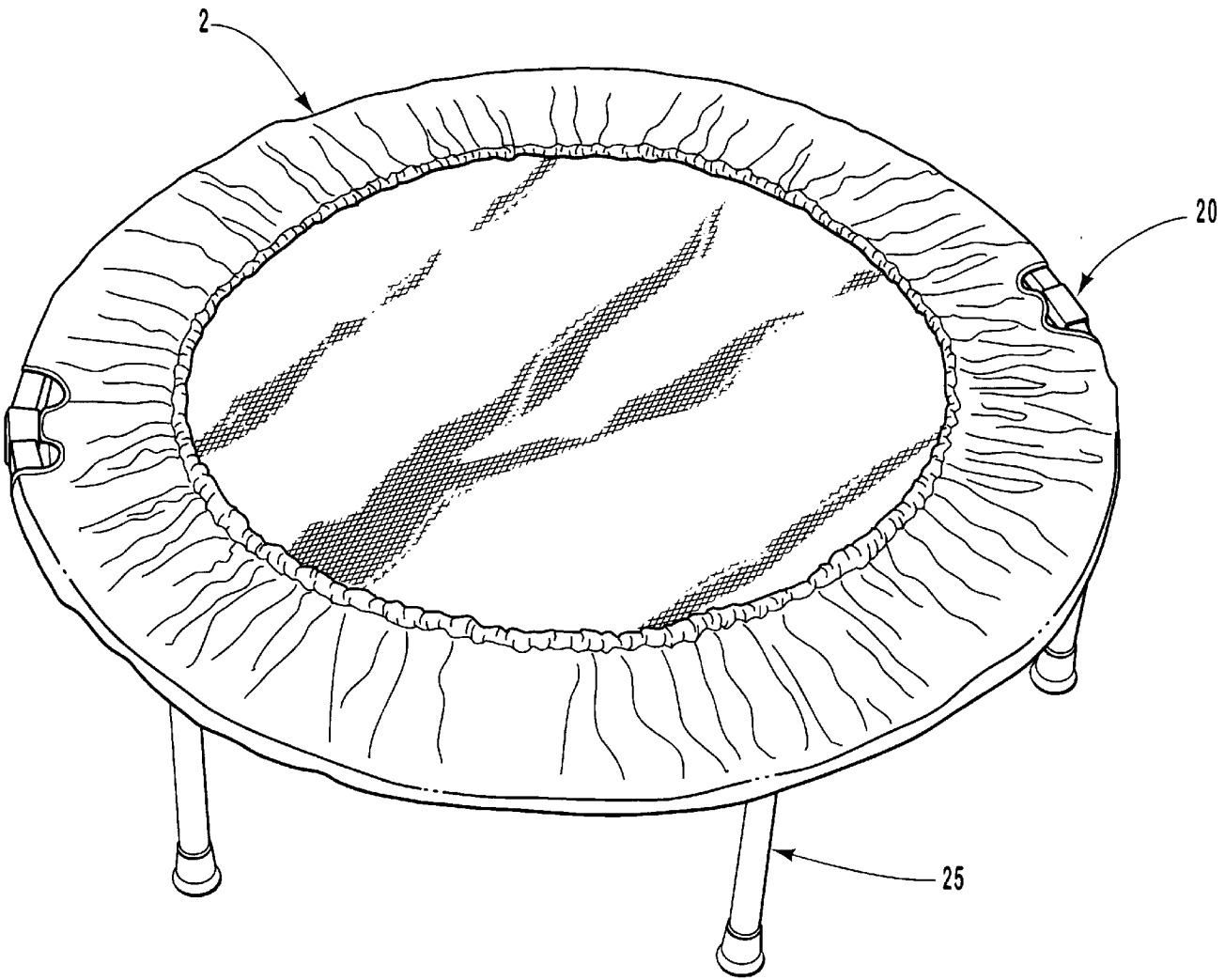
FIG. 1 is a view of an apparatus according to the present invention.

One aspect of the exercise apparatus of the present invention is a trampoline 2, as illustrated in FIG. 1. The trampoline is generally comprised of a frame 20 supported by legs 25. As depicted in FIG. 1, the diameter of the trampoline is about 40 inches and the height is about 10 inches. The present invention, however, could be easily modified for trampolines with different diameters and heights.

Figure 2:
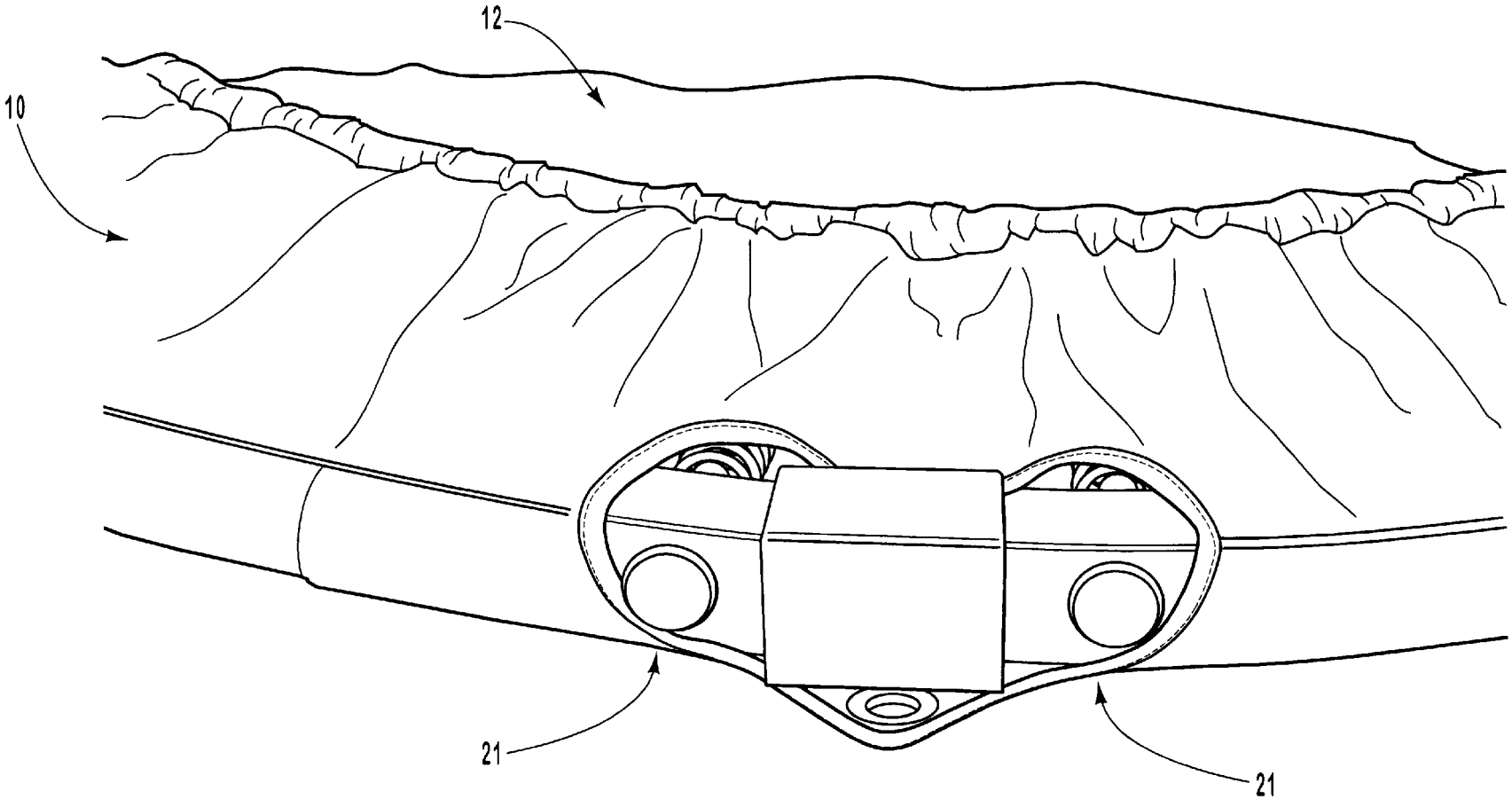
FIG. 2 is a close-up view of a hinge in the apparatus according to the present invention.

As shown in FIG. 2, the frame 20 comprises any suitable number of identical frame sections 21. The number of frame sections depends on the geometry of the trampoline, the length of the frame sections 21, and the size of the trampoline. In the aspect of the invention illustrated in FIG. 1, six frame sections are employed to make up the frame 20.

The frame sections cooperate to define any desired shape of the frame, such as a circular frame configuration. Although a circular peripheral configuration is preferred, any peripheral configuration capable of being formed by strait or curved frame sections can be utilized in accordance with the present invention. Examples of such other configurations include hexagonal, octagonal, square, rectangular, oval, etc. The frame sections can be made of various materials such as steel or other metals, aluminum, wood, plastic, reinforced plastic, composites, etc.

The trampoline illustrated in FIG. 1 comprises a plurality of supporting means, such as legs 25. Any number of legs can be used, depending on the support needed and the structural characteristics of the legs. The legs can be made of various materials such as steel or other metals, aluminum, wood, plastic, reinforced plastic, composites, etc. . . . Legs 25 are configured in any suitable manner that allows them to fold. Any "folding" configuration known in the art can be employed.

Figure 3:
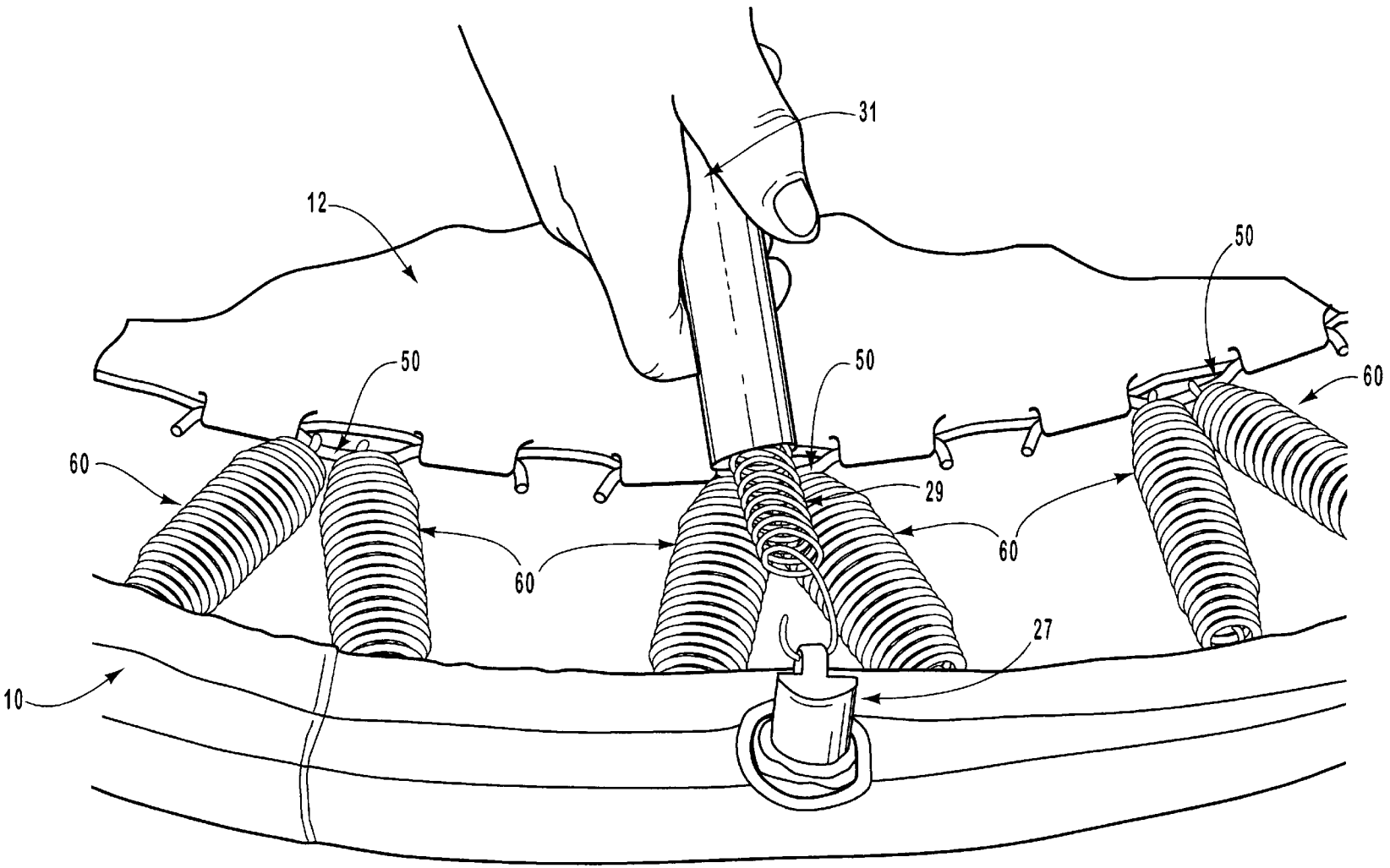
FIG. 3 is a close-up view of a leg of an apparatus of a according to the present invention.
Figure 4:
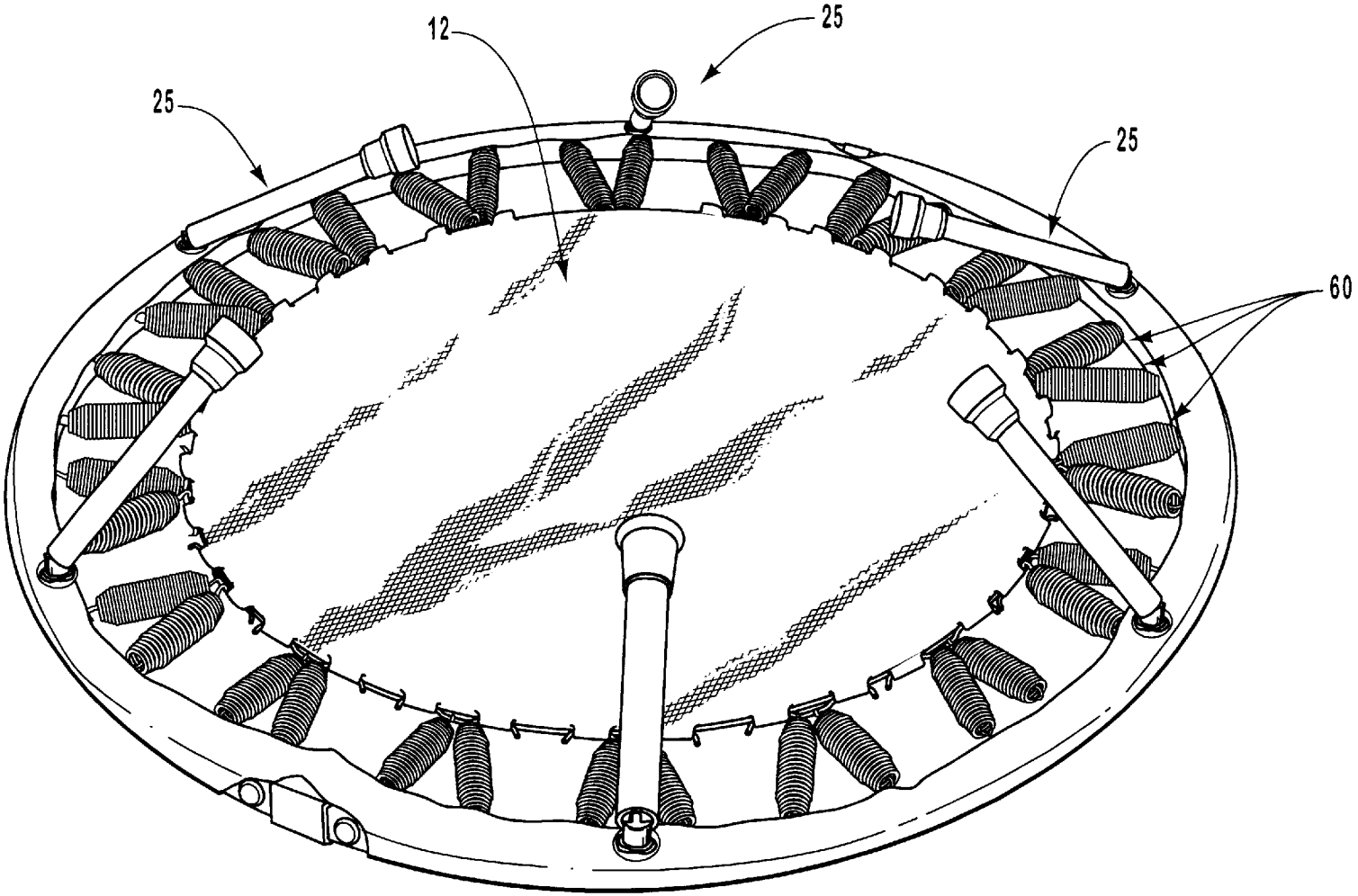
FIG. 4 is a view of an apparatus according to the present invention in a partially folded configuration.

One suitable configuration that allows the legs to fold is illustrated in FIG. 3, where legs 25 comprise base 27, spring 29, and extension member 31 with spring 29 removably connecting base 27 and extension member 31. In a first, non-folded position, the female end of extension member 31 fits over and encompasses the male end of the base, providing a rigid structure to support the loads to which the trampoline will be subjected. The extension member is held in this non-folded position by the action of the spring (or any similar mechanical device). In a second, folded position, as illustrated in FIG. 4, the female end of the extension member is removed (using force) from the base and the extension member is folded relative to the base Optionally, the present invention can include braces as known in the art to position trampoline 2. With such braces, mat 12 (described below) can be maintained in a substantially vertical or inclined plane (not shown), permitting trampoline to be used as a rebound device for various projectiles (not shown) as known in the art. See, for example, U.S. Pat. No. 4,415,151, the disclosure of which is incorporated herein by reference.

As illustrated in FIGS. 2 and 3, a mat 12 is secured to the frame 20 by conventional means of a plurality of springs 60. Any suitable mat known in the art can be employed in the present invention. See, for example, those described in U.S. Pat. No. 4,386,772, the disclosure of which is incorporated herein by reference. An annular cover 30 can optionally be arranged around frame 20 in a conventional manner so as to cover springs 60 adjacent the upper surface of mat 12 and enhance both the safety and the aesthetics of trampoline 2.

Figure 5:
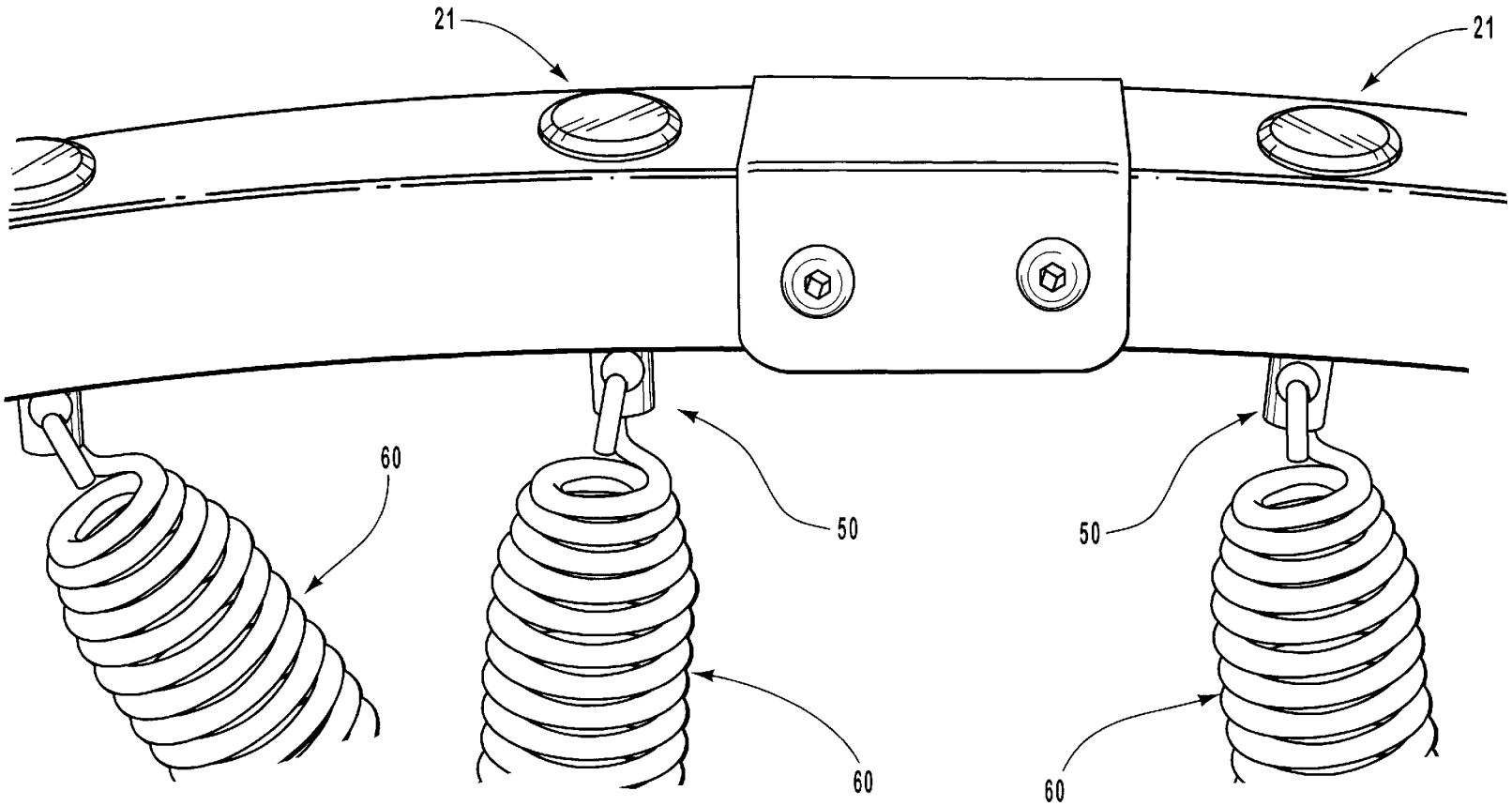
FIG. 5 is a close-up view of a hinge in the apparatus according to the present invention.

As illustrated in FIGS. 3 and 5, the springs 60 are secured on one end to the frame sections 21 via pins 50 that are connected to frame 20. On their other end, the springs are reasonably attached to the mat 12 via hooks 55 positioned on the edge of the mat at equal distances. These pins and hooks can be made of steel rods, aluminum rods, or plastic pieces. The hooks 55 are attached to the mat in order to equally apportion the force applied via springs 60 along the edge of mat 12. The number of hooks (and corresponding number of pins and springs) can be selected depending on the structural characteristics (i.e, flexibility and bounce) needed for mat 12.

The exercise apparatus of the present invention also contains means for pivoting the frame sections 21 relative to each other. Any suitable pivoting means known in the art can be employed for this function. See, for example, U.S. Pat. Nos. 4,386,772, 4,415,151, and 6,110,074, the disclosures of which are incorporated herein by reference. The pivoting means allows the exercise apparatus to fold or collapse into a smaller size.

Figure 6:
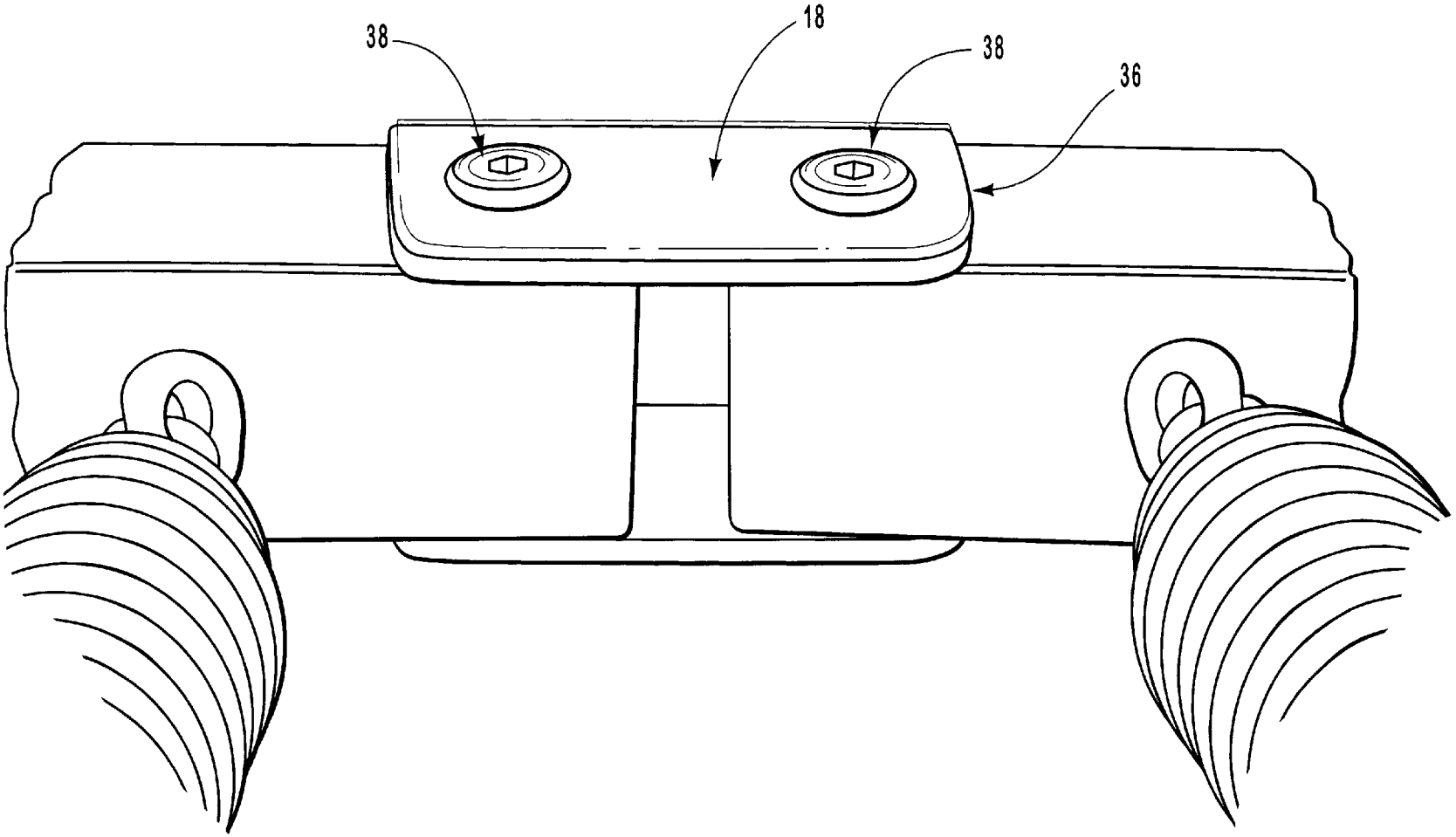
FIG. 6 is a close-up view of a hinge in the apparatus according to the present invention.

Preferably, the pivoting means illustrated in FIGS. 5 and 6 are employed in the present invention. These pivoting means include a pair of hinges 18 and a set of hinges 19. The pair of hinges 18 are disposed on opposite ends of the frame 20 such that a pivot axis is along a diametrical line of the circular frame 20, including the pair of hinges 18. In such a configuration, the hinges 18 permit frame 20 to be moved between a substantially planar open position as seen in FIG. 1 and a folded position depicted in FIG. 7.

Any suitable hinges 18 known in the art which permit such a folding configuration can be employed in the present invention. In a preferable aspect of the invention, the hinges depicted in FIGS. 2, 5 and 6 are employed as hinges 18. As depicted, the hinges 18 connect and encompass the respective frame sections 21. Thus, the hinges 18 are able to yield as the various loads are applied to the trampoline when it is in use.

Figure 7:
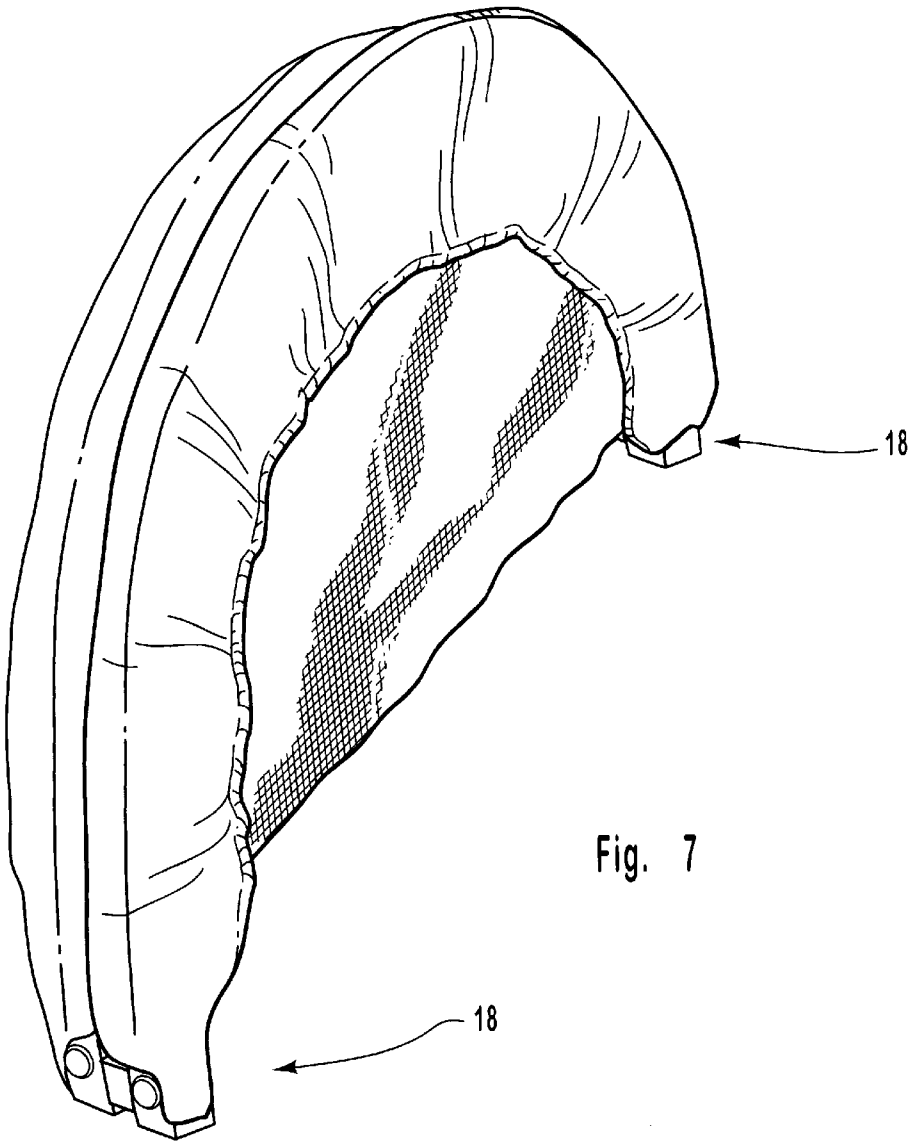
FIG. 7 is a view of an apparatus according to the present invention in a partially folded configuration.
Figure 8:
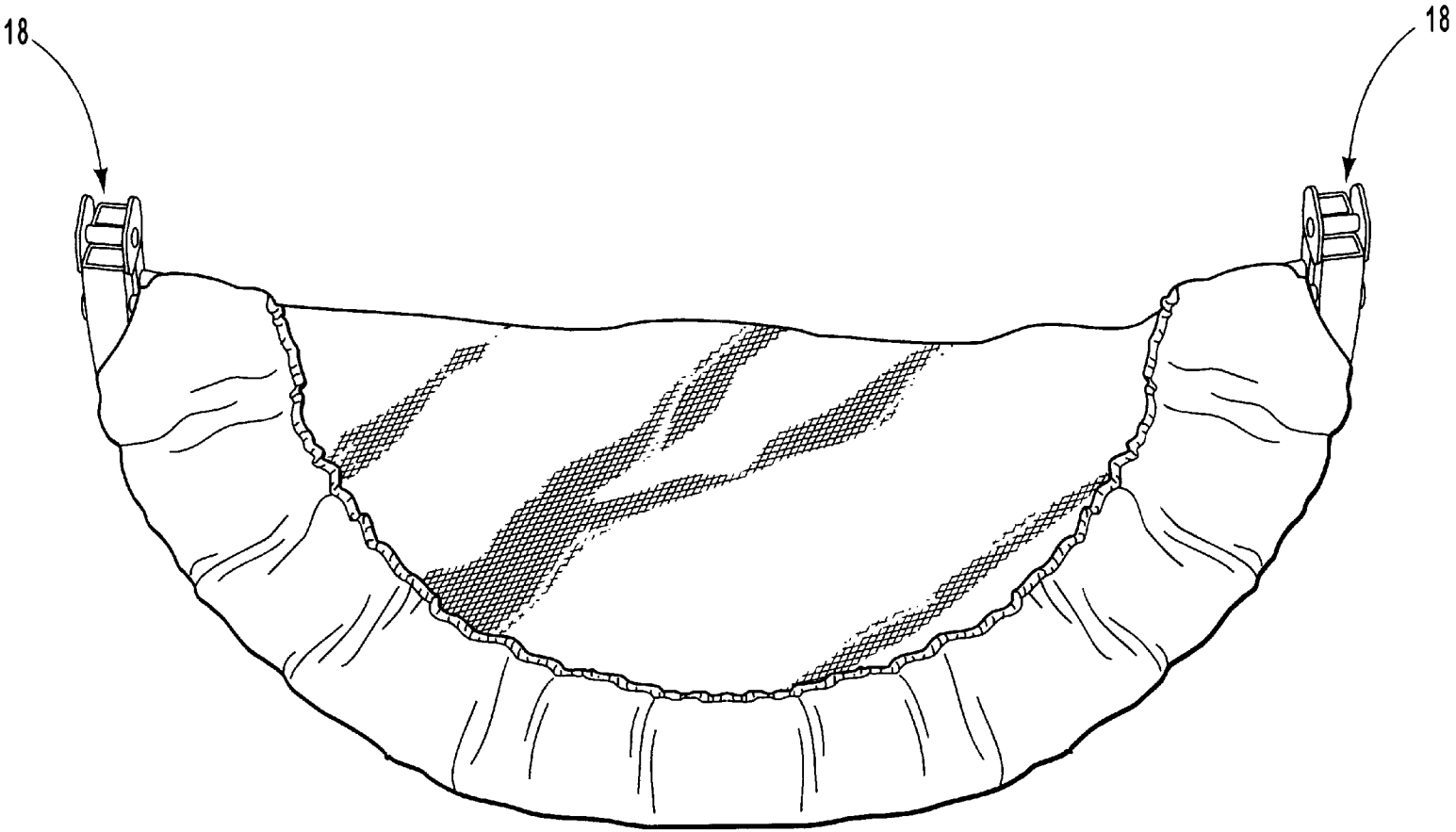
FIG. 8 is a view of an apparatus according to the present invention in a partially folded configuration.

The pivoting means also includes a set of hinges 19. The set of hinges 19 are disposed such that the trampoline can be further collapsed. In one aspect of the invention, four hinges 19 are used at 60° angles along the periphery from hinges 18, e.g., respective to a single hinge 18, four hinges 19 would be located at 60°, 120°, 240°, and 300°. In such a configuration, the hinges 19 permit frame 20 to be moved between a first folded position—as seen in FIGS. 7 and 8—to a second (and more compact) folded position depicted in FIG. 9. The second folded position is substantially triangular configuration, also referred to as a "tri-fold." If desired, additional hinges 19 could be provided to provide even more collapsed configurations.

Any suitable hinges 19 known in the art which permit such a folding configuration can be employed in the present invention. In a preferable aspect of the invention, the hinges depicted in FIGS. 2, 5 and 6 are employed as hinges 19. As depicted, the hinges 19 connect and encompass the respective frame sections 21. Thus, the hinges 19 are able to yield as the various loads are applied to the trampoline when it is in use.

In a preferred aspect of the invention, the hinges used as hinges 18 and those used as hinges 19 are substantially similar, if not identical. Thus, the hinges 18 and hinges 19 are interchangeable. Using such a configuration, the trampoline 2 can be folded into a semi-circular shape along a diametrical line including any two diametrically opposed hinges. The trampoline 2 can then be collapsed into the tri-fold position using the remaining four hinges.

The hinges 18 and 19 are configured to provide lateral flexibility in the framework, thereby decreasing the stress applied to the hinges (and increasing the life of the hinges) when the trampoline is folded. Any suitable hinge accomplishing this function can be employed in the present invention. In one aspect of the present invention, the hinges 18 and 19 are configured as depicted in FIG. 6.

In FIG. 6, the hinges 18 and 19 are configured as a "C"-shaped plate 36 partially enclosing frame sections 21 on the outer periphery and sides of the frame sections 21. The inner periphery of the frame sections 21 are not enclosed by the plate 36. The ends of the plate are removably connected to the frame sections 21 via connecting means 38. Any connection means known in the art can be employed in the present invention, such as the pins running through corresponding holds in the frame sections 21 and the plate 36.

Configuring the hinges in this manner allows for a flexible frame, e.g., a frame that provides a high degree of lateral movement. Conventional foldable trampolines have hinges that are permanently connected to the frame via welding or molding. When a user bounces on the trampoline, the lateral force imparted to the hinges from the bouncing motion causes structural damage. With the hinges of the present invention, however, the hinges are configured to yield more to this lateral force. Thus, the hinges are more flexible and they exhibit less structural damage. With less damage, the operating life of the hinges (and the exercise apparatus) are extended beyond the hinges and trampolines known in the art.

Figure 9:
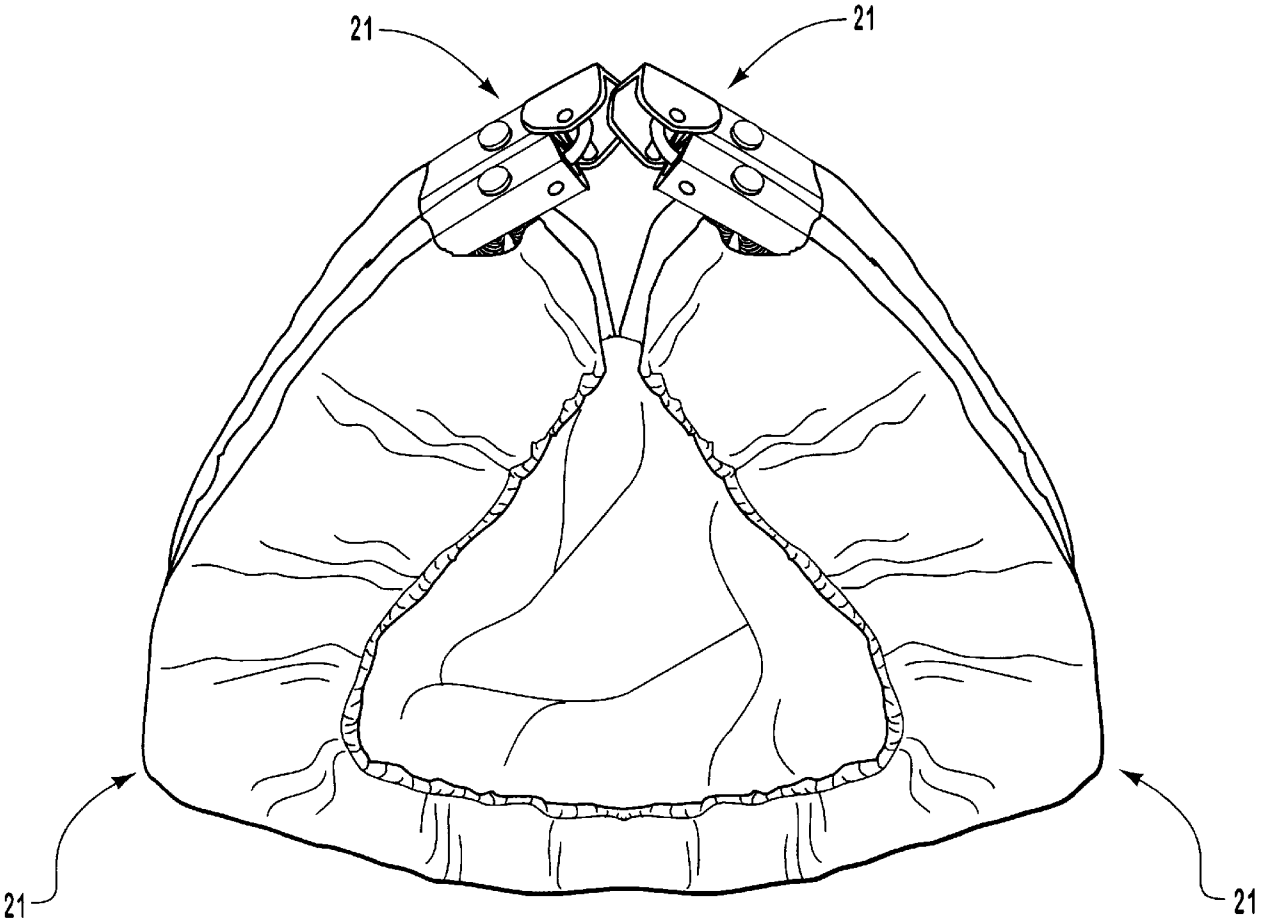
FIG. 9 is a view of an apparatus according to the present invention in a folded configuration.

The exercise apparatus of the present invention can be folded or collapsed in a quick and easy method. To begin the folding operation, the extension members 31 of legs 25 are removed from bases 27 as illustrated in FIG. 3. The legs 25 are all folded in an inward position as shown in FIG. 4. Then, the exercise apparatus, including frame 20, is folded in half into a semi-circular arrangement by using hinges 18, as seen in FIG. 7. After the first folding operation, the exercise apparatus can be further collapsed or folded by applying pressure to the outside of hinges 18 (see FIG. 8)

and pivoting about hinges 19 in the manner seen in FIG. 9, until the hinges 18 are proximate each other.

In this manner, a compact package is formed which can be stored and transported in a convenient manner, such as by use of a flexible bag or other suitable container construction. Preferably, the exercise device is collapsed/folded to make an ergonomic package, e.g., a compact package is formed which can be carried on a user's back between the shoulder blades.

Having described the preferred aspects of the present invention, it is understood that the invention defined by the appended claims is not to be limited by particular details set forth in the above description, as many apparent variations thereof are possible without departing from the spirit or scope thereof.

I claim:

1. An exercise apparatus, comprising;

a collapsible frame connected to a mat, the frame comprising a plurality of sections and the frame capable of collapsing into a substantially triangular shape;

four hinges located at about 60°, 120°, 240°, and 300° about said collapsible frame and wherein said four hinges are "C" shaped and have an end that is removably connected to said collapsible frame; and a plurality of foldable legs for supporting the frame.

2. The exercise device of claim 1, wherein the apparatus is a circular trampoline.

3. The exercise device of claim 2, wherein the frame is capable of collapsing using a plurality of hinges.

4. The exercise device of claim 3, wherein the plurality of hinges is six hinges located equidistant along the periphery of the exercise apparatus.

5. The exercise device of claim 4, wherein the hinges are configured to provide lateral flexibility in the framework.

6. A trampoline, comprising:

a collapsible frame connected to a mat, the frame comprising a plurality of sections and the frame capable of collapsing into a substantially triangular shape;

four hinges located at about 60°, 120°, 240° and 300° about said collapsible frame and wherein said four hinges are "C" shaped and have an end that is removably connected to said collapsible frame; and a plurality of foldable legs for supporting the frame.

7. The trampoline of claim 6, wherein the apparatus is a circular mini-trampoline.

8. The trampoline of claim 7, wherein the frame is capable of collapsing using a plurality of hinges.

9. The trampoline of claim 8, wherein the plurality of hinges is six hinges located equidistant along the periphery of the exercise apparatus and the hinges provide lateral flexibility in the framework.

10. An exercise apparatus, comprising:

a collapsible frame connected to a mat, the frame comprising a plurality of sections which collapse using a plurality of hinges providing lateral flexibility in the frame;

wherein said plurality of hinge further comprises four hinges located at about 60°, 120°, 240° and 300° about said collapsible frame and wherein said four hinges are "C" shaped and have an end that is removably connected to said collapsible frame; and a plurality of foldable legs for supporting the frame.

11. The exercise device of claim 10, wherein the plurality of hinges is six hinges located equidistant along the periphery of the exercise apparatus and the frame is capable of collapsing into a substantially triangular shape.

12. A trampoline, comprising:

a collapsible frame connected to a mat, the frame comprising a plurality of sections which collapse using a plurality of hinges providing lateral flexibility in the frame;

wherein said plurality of hinge further comprises four hinges located at about 60°, 120°, 240° and 300° about said collapsible frame and wherein said four hinges are "C" shaped and have an end that is removably connected to said collapsible frame; and a plurality of foldable legs for supporting the frame.

13. The trampoline of claim 12, wherein the plurality of hinges is six hinges located equidistant along the periphery of the exercise apparatus and the frame is capable of collapsing into a substantially triangular shape.

14. A method of collapsing a substantially circular trampoline containing a collapsing frame connected to a mat, the frame comprising a plurality of sections which collapse using plurality of hinges; the method comprising:

folding legs in an inward position;

folding the trampoline into a substantially semi-circular configuration wherein said folding said trampoline further comprises folding said frame about a first hinge positioned at about 60° on said frame and a second hinge positioned at about 240°;

folding said frame a second time about a third hinge positioned at about 120° on said frame and about said fourth hinge positioned at about 300° on said frame; and folding the trampoline into a substantially triangular shape.

15. The method of claim 14, including folding the trampoline into a substantially triangular shape by bringing the corners of the semi-circle into proximity with each other.

16. A collapsed exercise apparatus having a substantially triangular configuration, the apparatus comprising:

a collapsible frame connected to a mat, the frame comprising a plurality of sections which collapse using a plurality of hinges;

wherein said plurality of hinge further comprises four hinges located at about 60°, 120°, 240° and 300° about said collapsible frame and wherein said four hinges are "C" shaped and have an end that is removably connected to said collapsible frame; and a plurality of foldable legs for supporting the frame.

17. A collapsed trampoline having a substantially triangular configuration, the trampoline comprising:

a collapsible frame connected to a mat, the frame comprising a plurality of sections which collapse using a plurality of hinges;

wherein said plurality of hinges further comprises four hinges located at about 60°, 120°, 240° and 300° about said collapsible frame and wherein said four hinges are "C" shaped and have an end that is removably connected to said collapsible frame; and a plurality of foldable legs for supporting the frame.

* * * * *